US007766572B2

(12) United States Patent
Tranchant et al.

(10) Patent No.: US 7,766,572 B2
(45) Date of Patent: Aug. 3, 2010

(54) BOTTLE FOR A COSMETIC AND A METHOD OF USE

(75) Inventors: Jean-Francois Tranchant, Marigny-les-Usages (FR); Sylvie Bray-Richer, Boisny sur Bionne (FR)

(73) Assignee: LVMH Recherche, Saint Jean de Braye (FR)

( * ) Notice: Subject to any disclaimer, the term of this patent is extended or adjusted under 35 U.S.C. 154(b) by 701 days.

(21) Appl. No.: 11/612,260

(22) Filed: Dec. 18, 2006

(65) Prior Publication Data

US 2007/0160411 A1 Jul. 12, 2007

(30) Foreign Application Priority Data

Jan. 6, 2006 (FR) ..... 06 00136

(51) Int. Cl.
*A46B 11/00* (2006.01)

(52) U.S. Cl. ..... 401/129; 401/125; 401/126; 401/118; 401/32

(58) Field of Classification Search ..... 401/29–33, 401/36–39, 18, 24, 57, 68, 126–130, 85, 401/125, 16, 56, 55, 22, 25
See application file for complete search history.

(56) References Cited

U.S. PATENT DOCUMENTS 4,610,556 A * 9/1986 Tsai ..... 401/18
4,699,161 A * 10/1987 Smith et al. ..... 401/57
4,854,761 A * 8/1989 Smith et al. ..... 221/267
5,620,270 A * 4/1997 Gueret ..... 401/18
5,794,632 A 8/1998 Gueret
5,881,742 A * 3/1999 Hunsberger ..... 132/297
6,523,717 B1 * 2/2003 Willemsen ..... 221/267
6,551,265 B1 * 4/2003 Miguel ..... 401/57
6,568,529 B2 * 5/2003 McMurrey ..... 206/385
6,872,020 B2 * 3/2005 Epli ..... 401/127
7,083,350 B2 * 8/2006 Muller ..... 401/126
7,226,228 B1 * 6/2007 San Miguel ..... 401/57
2002/0170833 A1 11/2002 Muller

FOREIGN PATENT DOCUMENTS

FR 2 733 398 A 10/1996
WO WO 03/003873 A 1/2003

OTHER PUBLICATIONS

French Preliminary Search Report FR 0600136; report dated Aug. 11, 2006.
Written Opinion of European Patent No. EP 06 291 943.6.
European Search Report EP 06 29 1943; report dated Feb. 20, 2007.

* cited by examiner

*Primary Examiner*—David J. Walczak
*Assistant Examiner*—Keegan Gumbs
(74) *Attorney, Agent, or Firm*—Miller, Matthias & Hull

(57) ABSTRACT

A bottle comprising: a container containing a cosmetic; and an applicator including a tube that carries a first applicator head for applying cosmetic to a region of the body, the first applicator head being placed in front of the tube and being suitable for being dipped into the container, and the first applicator head being removable from the tube. The applicator also includes a second applicator head that is stored in the tube until the first applicator head is removed. The second applicator head is displaceable relative to the tube to take the place of the first applicator head.

8 Claims, 1 Drawing Sheet

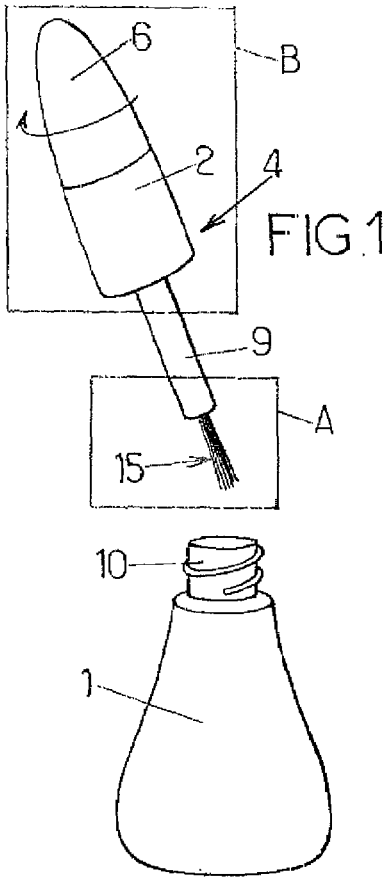
FIG.1
FIG.3
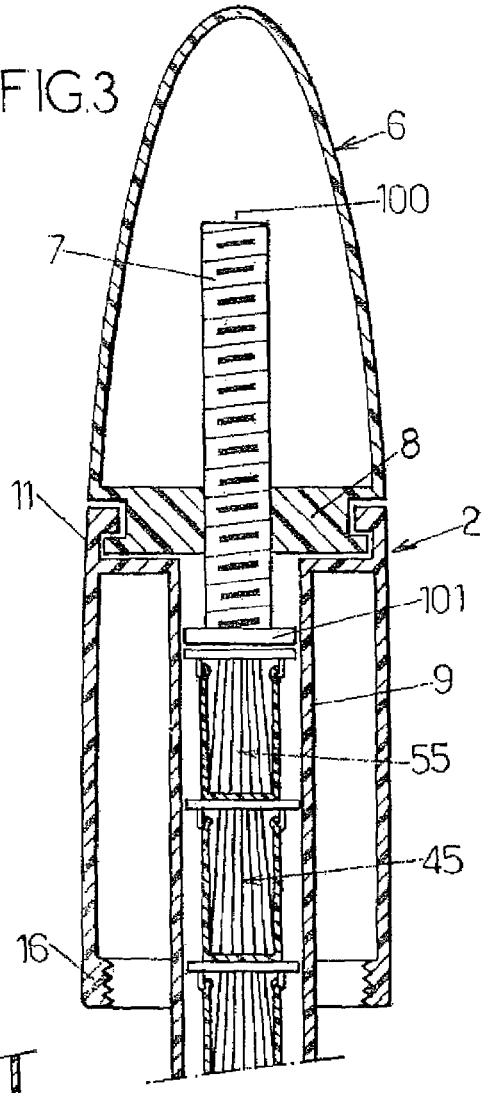
FIG.2.
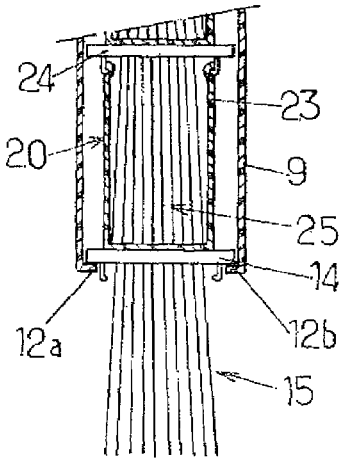
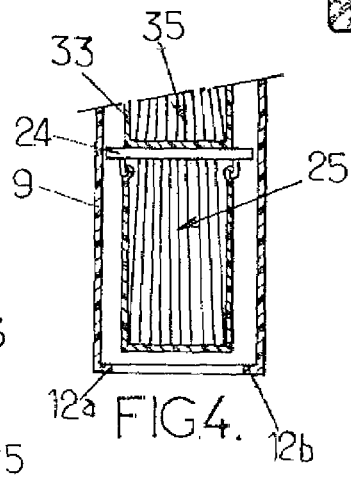
FIG.4.
FIG5.
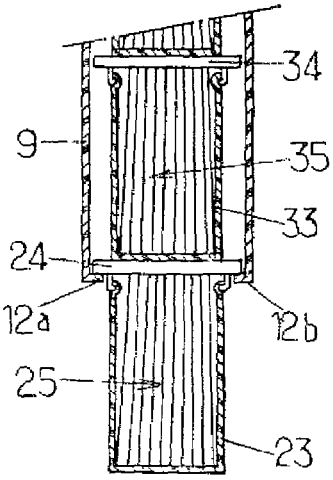

BOTTLE FOR A COSMETIC AND A METHOD OF USE

FIELD OF THE DISCLOSURE

The present invention relates to bottle for a cosmetic, such as a nail varnish, for example, and a method of using such a bottle.

More particularly, the invention relates to a bottle comprising: a container that is suitable for containing a cosmetic; and an applicator including a tube that carries a first applicator head for applying said cosmetic to a region of the body, said first applicator head being placed in front of the tube, said first applicator head being suitable for being dipped into the container so as to be soaked with cosmetic.

BACKGROUND OF THE DISCLOSURE

FIG. 5 of document WO03/003873 describes an example of a conventional bottle including an applicator head. Such a bottle becomes unusable when the applicator head is damaged, or more often when the cosmetic to be applied dries out and becomes stuck on said applicator head, even when the container is still full of cosmetic. In practice, firstly the frequent use of a single applicator head is likely to generate premature mechanical wear of said applicator head, and secondly the cosmetic remaining on said applicator head following multiple application operations dries out and hardens because of the evaporation of the volatile compounds present, which, for a single applicator head, affects the functionality of said applicator head and consequently reduces the quality of applications over time. Thus, there exists a need for a bottle of the type described above, enabling the applicator head to be replaced at any time.

On another type of bottle, document WO03/003873 itself proposes using various interchangeable applicator heads having different functionalities, and in the form of screw-on endpieces.

However, regardless of the type of bottle used, in order to be able to replace the various applicator heads, it is necessary to keep the applicator heads that have not yet been used in reserve in a safe location, so as to avoid them being lost or damaged. Replacing one applicator head by another is therefore neither quick nor easy

SUMMARY OF THE DISCLOSURE

To this end, in the invention, in a bottle of the kind in question, said first applicator head is removable, and the applicator also includes at least one second applicator head for applying said cosmetic to a region of the body, said second applicator head being stored in said tube until said first applicator head is removed, said second applicator head being displaceable relative to said tube to take the place of said first applicator head, after said first applicator head has been removed.

By means of such dispositions, the user has at least two applicator heads that can be manipulated in simple and practical manner. The applicator heads are contained in a tube of the applicator, thereby enabling the first removable applicator head to be replaced more quickly and more easily by the second applicator head.

In addition, the various applicator heads that have not yet been used are stored in reserve in a safe location, preventing them from being lost or damaged before use.

The first applicator head can be removed and replaced by the second applicator head when so desired by the user of the bottle, in particular when the first applicator head is damaged, or when the quality of the application diminishes over time as a result of the cosmetic drying out on the applicator head.

The term "first applicator head" refers to the head that is positioned to apply the cosmetic while the bottle is being used, regardless of whether said applicator head was, when the bottle was used for the first time, the original applicator head disposed to apply the cosmetic, or a subsequent applicator head that was stored inside the tube while the bottle was being used for the first time. Consequently, the term "second applicator head" refers to the applicator head that is situated behind the "first applicator head".

In preferred embodiments of the invention, it is also possible to use one or more of the following dispositions:

- the container contains nail varnish as the cosmetic;
- the bottle further comprises a longitudinal-displacement system for displacing said second applicator head longitudinally along the longitudinal axis of the tube;
- the longitudinal-displacement system comprises:
  - a piece that turns relative to the tube along the longitudinal axis of said tube;
  - a part that is movable in translation along the longitudinal axis of the tube;
  - said piece co-operating with said part in such a manner that by turning said piece, said part is caused to move in translation;
  - said part being for displacing said second applicator head;
- each applicator head comprises a plurality of bristles, at least the second applicator head being contained in a capsule, said capsule being contained in said tube;
- the capsule comprises:
  - a cover to which there is fastened the plurality of bristles; and
  - a protective element that is connected in removable manner to the cover;
- the rigid protective element of said second applicator head bears against the cover of said first applicator head;
- the tube is secured to a cap for alternately opening and closing said container; and
- an original applicator head disposed in the container before first use is also contained in a capsule.

The invention also provides a method of using a bottle comprising: a container that is suitable for containing a cosmetic; and an applicator including a tube that carries a first applicator head for applying said cosmetic to a region of the body, said first applicator head being placed in front of the tube, said first applicator head being suitable for being dipped into the container so as to be soaked with said cosmetic, said applicator also includes at least a second applicator head for applying said cosmetic, said second applicator head being stored in said tube until said first applicator head is removed, the method comprising the steps of:

- removing said first applicator head from the tube; and then
- displacing said second applicator head relative to said tube until it takes the place of said first applicator head, after said first applicator head has been removed.

In another aspect, during the method, provision is made for a cosmetic contained in the container to be applied to a region of the body by means of said second applicator head.

BRIEF DESCRIPTION OF THE DRAWINGS

Other characteristics and advantages of the invention appear from the following description of one of its embodiments, given by way of non-limiting example, and with reference to the accompanying drawing.

In the drawing:

FIG. 1 is a general view of an example of a bottle in accordance with the invention, shown in its open position, and with a first applicator head that is ready to use;

FIG. 2 is a larger-scale view in axial section of the portion A shown in FIG. 1;

FIG. 3 shows, still in larger-scale axial section, the portion B shown in FIG. 1; and FIG. 4 and FIG. 5 are views similar to FIG. 2 showing the method of renewing applicator heads.

MORE DETAILED DESCRIPTION

In the various figures, the same references designate elements that are identical or similar.

In the embodiment shown in FIG. 1, the bottle comprises a container 1 containing a cosmetic, and a cap 2 carrying the applicator 4, at the end of which there is placed a first applicator head 15 in the ready-to-use position. By way of example, the container 1 includes a thread 10 for receiving the cap 2, thereby making it possible to close the container 1, by screwing in this event, when it is no longer desired to use the bottle.

As can be seen in FIGS. 1, 2, and 3, the applicator 4 is in the form of a hollow tube 9 that is carried by the cap 2 at one of its ends, and that includes a first applicator head 15 at its other end.

As can be seen more precisely in FIG. 2, the first applicator head 15 in a ready-to-use position includes a cover 14 to which there is fastened a plurality of bristles in the form of a brush. The cover 14 is retained at the bottom end of the tube 9 by inner radial abutments 12*a* and 12*b*. The second applicator head 25, stored behind the first applicator head 15 in the tube 9, includes, in addition to its cover 24, a protective element 23 that is connected in removable manner to the covet 24, e.g. by clipping. The protective element 23 and the cover 24 together define a capsule 20 protecting the second applicator head 25. The capsule 20 avoids the second applicator head 25 being soaked with cosmetic when the first applicator head 15 is dipped into the container 1. In addition, said capsule makes the above-mentioned longitudinal-displacement system for longitudinally displacing the applicator heads more effective.

When the first applicator head 15 is damaged or becomes unusable, it is removed from the tube 9 of the applicator 4 by the user, e.g. by elastically deforming the bottom end of said applicator head.

As can be seen in FIG. 4, the second applicator head 25, stored in the tube 9 behind the first applicator head 15, must now be displaced towards the abutments 12*a* and 12*b* at the end of the tube 9, so as to be operational, in turn, when the cover 24 of the second applicator head 25 is in abutment against said abutments 12*a* and 12*b* of the tube 9.

To do this, the bottle includes a longitudinal-displacement system for displacing the applicator heads longitudinally, enabling quick and easy replacement of said applicator heads, which is described in greater detail below with reference to FIG. 3 in particular.

As can be seen in FIGS. 1 and 3, the cap 2 can comprise two portions that are mounted to turn relative to each other.

The first is in the form of a support 11 that comprises firstly a cylindrical outer casing, e.g. made of transparent plastics material, carrying, on its inside face, bore 16 that is complementary to the thread 10 of the container 1, and secondly the applicator 4 in the form of the tube 9, e.g. of the same material as the outer casing and secured to said casing. Said applicator extends over a length that is defined in such a manner that the applicator head placed at its end plunges into the container as far as its bottom wall when the bore and the thread are mutually engaged.

The second portion comprises a control piece 6 that is rotatably mounted on the support 11, and that forms a top of the cap 2 that extends radially inwards. The control piece 6 includes a base forming a nut 8 with which a part 7 cooperates in translation, in this embodiment a screw extending between a top end 100, inside the control piece 6 and through the nut 8, and an abutment-forming widened bottom end 101 that is disposed inside the tube 9 in order to serve as a piston on the covet of the last applicator head 55 available in the tube 9 in the present embodiment.

The screw 7 includes means for preventing it from turning about the longitudinal axis of the tube 9. For example, it includes a slot over its entire length (not shown in FIG. 3), and the tube 9 includes, in its inside top portion, a projection that is inserted in the slot and that thus prevents the part 7 from turning.

In the embodiment described, including 5 applicator heads 15, 25, 35, 45, 55, the above-described longitudinal-displacement system functions as follows While the piece 6 is being turned, the portion 11 of the cap 2 remains stationary, whereas the screw 7, which can move in translation along the longitudinal axis of the tube 9, causes the last applicator head 55 that is contained in the tube and that is directly in contact with the bottom end 101 of the screw 7 to be displaced directly by thrust. The last applicator head 55 causes the displacement of the applicator head 45 that is situated directly thereunder. This displacement can be facilitated when the protective elements, made of transparent plastics material, for example, are rigid. Thus, the applicator heads contained in the tube 9 slide progressively along the axis of the tube 9 until the second applicator head 25 contained in the tube 9 takes the place of the first applicator head 15 that has already been removed from the tube 9.

As shown in FIG. 5, the second applicator head 25 still includes the protective element 23 after it has been displaced along the tube 9.

The protective element 23 must thus be removed, e.g. manually, before the new applicator head 25 is used for the first time.

The above-described operation can be repeated as often as necessary, within the limit of the available applicator heads.

In an advantageous variant of the invention, the first applicator head 15 can initially likewise be protected from its outside environment by a protective element 13 (not shown) that is similar to the protective elements of the other applicator heads, thereby optimizing use of the first applicator head for the user.

Naturally, the invention is not limited in any way to the embodiments described and shown, which are given only by way of example.

What is claimed is:

1. A bottle comprising:

a container containing nail varnish as a cosmetic; and an applicator including a tube that carries a first applicator head for applying said cosmetic to a region of a body, said first applicator head being placed in front of the tube, said first applicator head being suitable for being dipped into the container so as to be soaked with said cosmetic, wherein said first applicator head is removable from said tube, and wherein the applicator also includes at least one second applicator head for applying said cosmetic to a region of the body, said second applicator head being stored in said tube until said first applicator head is removed, said second applicator head being movable along the longitudinal axis of said tube to take the place of said first applicator head, after said first applicator head has been removed.

2. A bottle according to claim 1, further comprising a longitudinal-displacement system for displacing said second applicator head longitudinally along the longitudinal axis of the tube.

3. A bottle according to claim 2, in which the longitudinal-displacement system comprises:

a piece that turns relative to the tube along the longitudinal axis of said tube;

a part that is movable in translation along the longitudinal axis of the tube; said piece co-operating with said part in such a manner that by turning said piece, said part is caused to move in translation along the longitudinal axis of the tube; said part being for displacing said second applicator head.

4. A bottle comprising:

a container that is suitable for containing a cosmetic; and an applicator including a tube that carries a first applicator head for applying said cosmetic to a region of a body, said first applicator head being placed in front of the tube, said first applicator head being suitable for being dipped into the container so as to be soaked with said cosmetic, wherein said first applicator head is removable from said tube, and wherein the applicator also includes at least one second applicator head for applying said cosmetic to a region of the body, said second applicator head being stored in said tube until said first applicator head is removed, said second applicator head being movable along the longitudinal axis of said tube to take the place of said first applicator head, after said first applicator head has been removed, in which each applicator head comprises a plurality of bristles, at least the second applicator head being contained in a capsule, said capsule being contained in said tube.

5. A bottle according to claim 4, in which said capsule comprises:

a cover to which there is fastened the plurality of bristles; and a protective element that is connected in removable manner to the cover.

6. A bottle according to claim 5, in which the protective element of said second applicator head bears against the cover of said first applicator head.

7. A bottle according to claim 4, in which an original applicator head disposed in the container before first use is also contained in a capsule.

8. A bottle according to claim 1, in which said tube is secured to a cap for alternately opening and closing said container.

* * * * *